US005546169A

United States Patent [19]

Wada et al.

[11] Patent Number: 5,546,169

[45] Date of Patent: Aug. 13, 1996

[54] COPYING MACHINE WITH IMAGE SUPERPOSITION CAPABILITY

[75] Inventors: Takasumi Wada; Hirokazu Fujita, both of Nara; Koichi Inui, Higashiosaka, all of Japan

[73] Assignee: Sharp Kabushiki Kaisha, Osaka, Japan

[21] Appl. No.: 412,057

[22] Filed: Mar. 28, 1995

[30] Foreign Application Priority Data

Apr. 21, 1994 [JP] Japan ..... 6-083123

[51] Int. Cl.[6] ..... G03G 15/00

[52] U.S. Cl. ..... 355/244; 355/210

[58] Field of Search ..... 355/244, 245, 355/210; 358/401; 346/160

[56] References Cited

U.S. PATENT DOCUMENTS

| | | | |
|---|---|---|---|
| 4,545,669 | 10/1985 | Hays et al. . | |
| 4,697,913 | 10/1987 | Kuramoto et al. . | |
| 4,819,019 | 4/1989 | Egawa et al. . | |
| 4,851,926 | 7/1989 | Ishikawa | 358/300 |
| 4,921,768 | 5/1990 | Kunugi et al. | 430/45 |
| 5,276,486 | 1/1994 | Ohno et al. | 355/220 |
| 5,346,791 | 9/1994 | Ozawa et al. | 430/106.6 |

OTHER PUBLICATIONS

T. Toshio et al., Japanese KOKAI (Published unexamined patent application) No. 19755/1982 (Tokukaisho 57–19755).

I. Tadashi et al., Japanese KOKAI (Published unexamined patent application) No. 66450/1982 (Tokukaisho 57–66450).

Japanese KOKOKU (Published examined patent application) No. 4900/1990 (Tokukohei 2–4900).

Japanese KOKOKU (Published examined patent application) No. 64864/1991 (Tokukohei 3–64864).

*Primary Examiner*—R. L. Moses

*Attorney, Agent, or Firm*—David G. Conlin; Peter F. Corless

[57] ABSTRACT

An image forming apparatus includes a charging roller for charging a surface of a photoconductive layer in a photoreceptor so as to have a prescribed polarity, a first exposing unit which is arranged on a downstream side of the charging roller on the basis of a direction in which the photoreceptor moves, a developer unit which is placed on a downstream side of the first exposing unit and which keeps toner, to which a charge with a polarity opposite to the prescribed polarity is applied, in contact with a photoconductive layer, and a second exposing unit for directing light generated according to an image signal to a back of the photoconductive layer at a contact position of the toner and the photoconductive layer. The first exposing unit directing light reflected from a document to which a light is applied to the surface of photoconductive layer so as to form a first electrostatic latent image. The second exposing unit forms a second electrostatic latent image by interlocking or synchronizing with the developing operation of the developer unit. This makes it possible to easily form a synthetic image at a high speed by superimposing characters printed by a printer function onto a copy image formed by a copying function, for example.

20 Claims, 7 Drawing Sheets

20
5
3c
3b
3a
Y
3

EXPOSING
3c
3b
3a
Y
3

6b
21
3c
3b
3a
Y
4
3

20
5
3c
3b
3a
3
Y
E
EXPOSING
6b
21
4

COPYING MACHINE WITH IMAGE SUPERPOSITION CAPABILITY

FIELD OF THE INVENTION

The present invention relates to an image forming apparatus having a copying function as well as an overlay function for superimposing a printer image according to an image signal on a copy image formed by the copying function.

BACKGROUND OF THE INVENTION

Conventionally, an image forming apparatus such as an electrophotographic printing machine adopts one of two developing system: (1) a normal developing system for carrying out development by adhering toner to an unexposed portion of a photoreceptor and (2) a reversal developing system for carrying out development by adhering toner to an exposed portion of a photoreceptor. In the case where development is carried out by using a photoreceptor to which a charge having a negative polarity is applied, for example, in the normal developing system, development is carried out by using toner having a positive polarity, and on the contrary, in the reversal developing system, development is carried out by using toner having a negative polarity which is same as a charge polarity of the photoreceptor.

As to an image forming method which adopts the reversal developing system, Japanese Examined Patent Publication NO. 2-4900/1990 (Tokukohei 2-4900) discloses a "picture image forming method" and Japanese Examined Patent Publication 3-64864/1991 (Tokukohei 3-64864) discloses an "image forming method".

In the "picture image forming method" disclosed in Japanese Examined Patent Publication 2-4900/1990 (Tokukohei 2-4900), a photoreceptor to which a light transmitting electrically conductive layer, a photoconductive layer and an insulating layer are provided in this order is used, and electrically conductive and magnetic toner carried by magnetic force is supplied to a surface of the insulating layer in the photoreceptor. Next, while a voltage is being applied between the toner and the light transmitting electrically conductive layer, the photoconductive layer is exposed so that a pair of charges having an opposite polarity is formed between the photoconductive layer and the toner between which the insulating layer is put in an exposed portion. As a result, the toner is electrostatically absorbed on a surface of the photoreceptor by defeating magnetic force for carrying the toner. Meanwhile, toner absorbed on the unexposed portion is removed from the surface of the insulating layer by the magnetic force after the exposure. In such a way, a desired image is formed.

In addition, in the "image forming method" disclosed in Japanese Examined Patent Publication 3-64864/1991 (Tokukohei 3-64864), toner having conductivity and magnetism is allowed to contact with a photoreceptor, and a voltage is applied to the photoreceptor. Next, a light having image information is irradiated from a conductive layer side of the photoreceptor, and the toner is allowed to electrostatically adhere to an exposed portion of the photoreceptor so that a toner image is formed. In such a way, a desired image is formed.

In addition, as an information processing apparatus such as a computer has been in common use in recent years, more printers which adopt an electrophotographic printing method have been used as printing means for information. Such a printer, which adopts the electrophotographic printing method, generally adopts the reversal developing system as a developing method. Meanwhile, a copying machine which adopts an electrophotographic printing system generally adopts the normal developing system as a developing system.

Incidentally, in general, since a developing system of a copying function is different from that of the printer function, the polarity of toner to be used for development is also different. For this reason, it is hard to form an image by means of both the copying function and the printer function through a series of image forming processes using one photoreceptor. For this reason, in order to superimpose an image on a copy image using a printer, a document is copied by a copying machine, and it is necessary to carry out a desired printing on copied paper by a printer. As a result, the machine has a problem of operability, so there arises a problem that the time it takes to form an image by superimposing an image on a copy image by a printer becomes long.

In addition, in order to perform the copying function and the printer function in one machine, a machine, which adopts the normal developing system for printing an unexposed portion as the printer function is suggested. However, in this case, since a ratio of a light emitting time of writing and exposing means to an operating time of the printer function exceeds 90%, there arises problems such as overheat of the writing and exposing means, a reduction in a service life. Moreover, there is a possibility that an unexposed portion to be printed is blotted with an exposed portion, thereby arising a problem that an excellent image cannot be formed.

Furthermore, since in the image forming method which adopts the reversal developing system, an exposed portion is developed, it is necessary that a photoreceptor is charged with a high voltage. For this reason, a charging unit which generates a high voltage is required. Therefore, there arises a problem of increased size of an apparatus.

SUMMARY OF THE INVENTION

It is an object of the present invention to provide an image forming apparatus which is capable of easily forming an image, which is synthesized by a series of image forming processes, at a high speed by superimposing a first electrostatic latent image corresponding to a first document and a second electrostatic latent image corresponding to a second document using one photoreceptor.

In order to achieve the above object, an image forming apparatus of the present invention is characterized by including at least:

(1) a photoreceptor which is capable of moving in a prescribed direction, said photoreceptor being provided with a light transmitting base material, a light transmitting electrically conductive layer and a photoconductive layer in this order;

(2) charging means for charging a surface of the photoconductive layer so as to have a prescribed polarity;

(3) first exposing means for irradiating a light on a first position of the photoconductive layer in a lower stream side of said charging means on the basis of a moving direction of said photoreceptor so as to form a first electrostatic latent image;

(4) developing means for developing the first electrostatic latent image while a developer, which is charged so as to have a polarity opposite to the polarity of the charging means, contacts with the photoconductive layer, the developing means being provided in a lower stream side of the first exposing means; and (5) second exposing means for irradiating a light on a contact portion of the developer and of the photoconductive layer by interlocking with the developing operation of the developing means so as to form a second electrostatic latent image with it superimposed on the developed first latent image.

With the above arrangement, first, the surface of the photoconductive layer is charged by the charging means so as to have a prescribed polarity, and it has a prescribed potential. Next, in order to form the first electrostatic latent image on the charged photoconductive layer, a light is irradiated on the photoconductive layer by the first exposing means. Here, a portion of the photoconductive layer which is exposed by the light is referred to as a first light portion and a portion other than the first light portion as a first dark portion.

At this time, optical carriers are generated inside the first light portion of the photoconductive layer. The optical carriers with a polarity opposite to that of the charges accumulated on the surface of the photoconductive layer in the generated optical carriers are attracted by the charges in the first light portion. As a result, in the first light portion, the charges are cancelled and a potential becomes substantially 0 V. Meanwhile, since optical carriers are not generated in the first dark portion, the charges are left accumulated on the surface of the photoconductive layer. In this way, the first electrostatic latent image is composed of the first light portion where the charges are cancelled and the first dark portion where the charges are accumulated.

Next, the developer to which a charge with a polarity opposite to that of the charging means is applied is brought into contact with the photoconductive layer by the developing means. Moreover, the second exposing means irradiates a light to the contact portion of the developer and of the photoconductive layer from the light transmitting base material side interlocking with the developing operation of the developing means and forms the second electrostatic latent image on the photoconductive layer.

At this time, since the potential is substantially 0 V in the first light portion, the charged developer is not attracted to the first light portion. On the contrary, since the first dark portion is charged so as to have a polarity opposite to the charged polarity of the developer, the developer electrostatically is attracted to the first dark portion. In this way, since the developer is attracted to the unexposed portion, the first electrostatic latent image is developed by a normal developing system.

Meanwhile, an exposed portion in the photoconductive layer by the second exposing unit is referred to as a second light portion, and an unexposed portion as a second dark portion. In the second light portion, the optical carriers with a polarity opposite to that of the developer which contacts with the photoconductive layer in the optical carriers generated in the photoconductive layer and the developer electrostatically attract each other. As a result, the developer attracted to the second light portion. Moreover, since optical carriers are not generated on the second dark portion in the photoconductive layer, the charges do not move. Therefore, a developer absorbing state in the first electrostatic latent image do not change. In this way, since the developer is attracted to the exposed portion by the second exposing unit, the second electrostatic latent image is developed by a reversal developing system.

Considering the circumstances mentioned above, in a series of the image forming processes, it is possible to perform overlay, that is, the second electrostatic latent image by the second exposing means is superimposed on the first electrostatic latent image formed by the first exposing means so that the first electrostatic latent image and the second electrostatic latent image are synthetically developed. Furthermore, the first electrostatic latent image and the second electrostatic latent image can be simultaneously developed by using toner having same polarity.

Therefore, it is possible to easily form a synthetic image at a high speed by superimposing characters printed by the printer function on a copy image formed by the copying function, for example.

For a fuller understanding of the nature and advantages of the invention, reference should be made to the ensuing detailed description taken in conjunction with the accompanying drawings.

DESCRIPTION OF THE EMBODIMENTS

[EMBODIMENT 1]

Figure 1:
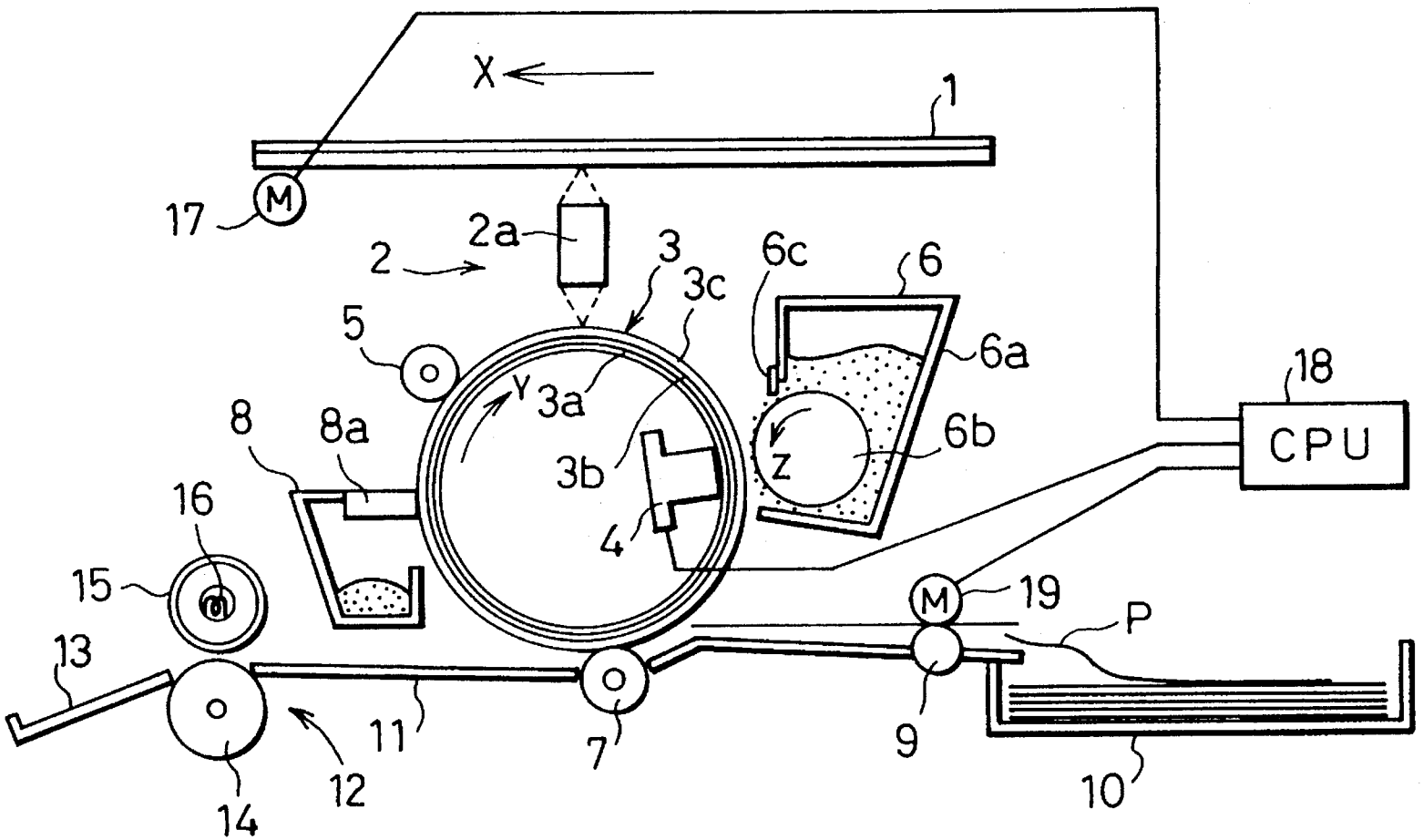
FIG. 1 is an explanatory drawing which schematically shows one constitutional example of an image forming apparatus of the present invention.

As shown in FIG. 1, an image forming apparatus of the present embodiment is provided with a document platen 1 in an upper position, a first exposing unit 2 as first exposing means and a photoreceptor 3 below the document platen 1. The document platen 1 moves in a direction of arrow X at the time of scanning a document. The photoreceptor 3 rotates in a direction of arrow Y.

The first exposing unit 2 is composed of a light source (not shown) and a focusing rod lens array 2*a*. The light source directs a light onto a document (not shown) placed on the document platen 1, and the focusing rod lens array 2*a* focuses light reflected from the document on a surface of the photoreceptor 3. In other words, an image corresponding to the document is formed by exposing the surface of the photoreceptor 3.

The photoreceptor 3 has an arrangement that a light transmitting electrically conductive layer 3*b* composed of ITO (Indium-tin Oxide) film and a photoconductive layer 3*c* composed of amorphous silicon, etc. are laminated on a cylindrical light transmitting base material 3*a* composed of glass, or other materials. A second exposing unit 4 as second exposing means which exposes the photoreceptor 3 from its inside is provided inside the photoreceptor 3.

The second exposing unit 4 composed of a LED (Light Emitting Diode) rod lens array exposes the photoreceptor 3 according to an image signal from an external apparatus such as a computer, not shown. Here, as the second exposing unit 4, the LED rod lens array is used in the present embodiment, but the second exposing unit 4 may be an optical means which carries out exposure correspondingly to a black portion of a document according to an electric signal, so besides the LED rod lens array, an ELD (Electric Luminescent Display), a liquid crystal shutter or a scan exposing unit having a laser is suitably used.

In addition, the second exposing unit 4 is arranged in a position which is opposite to a portion where the photoreceptor 3 is developed. As a result, the photoreceptor 3 can be continuously exposed by the first exposing unit 2 and the second exposing unit 4.

Here, the exposing operations by the first exposing unit 2 and the second exposing unit 4 will be explained in detail later.

In addition, a charging roller 5 as charging means for giving a prescribed electric potential to the surface of the photoreceptor 3, a developer unit 6 as developing means for developing an electrostatic latent image by allowing developer (hereinafter, referred to as toner) to adhere to the electrostatic latent image formed on the surface of the photoreceptor 3, a transferring roller 7 for transferring a toner image on the surface of the photoreceptor 3 onto transfer paper P, a cleaning unit 8 for collecting residual toner on the surface of the photoreceptor 3, a charge eliminating unit (not shown) for neutralizing a charge on the photoreceptor 3, etc. are provided on the periphery of the photoreceptor 3.

The developer unit 6 is composed of a container **6*a* for storing toner (hereinafter, referred to as toner T) as developer, a cylindrical developing roller 6*b* which hold the toner T on its surface and which rotates in a direction of arrow Z and a doctor 6*c* for controlling a height of magnetic brushes of the toner T held by the developing roller 6*b***.

Here, the toner T is composed of color particles having conductivity and magnetism, namely, particles including magnetic particles made up of ferrite and carbon black in styrene-acrylic resin.

The developing roller **6*b* is composed of a non-magnetic and conductive cylindrical member which is rotatable and which contains aggregate of magnets. The toner composed of color particles having conductivity and magnetism is held on the cylindrical member by relative movement of the cylindrical member and the contained aggregate of magnets so as to be carried. At this time, since the toner T is held on a surface of the developing roller 6*b* in a brush-like configuration, the height of the magnetic brushes of the toner T is controlled by the doctor 6*c* in order to allow the toner T to uniformly contact with the photoreceptor 3**.

In addition, the cleaning unit 8 has a blade **8*a* which contacts with the surface of the photoreceptor 3, and the toner T left on the surface of the photoreceptor 3 is scraped off by the blade 8*a*** so as to be collected.

In addition, a feeding roller 9 for feeding the transfer paper P at predetermined intervals and a transfer paper storing cassette 10 for storing the transfer paper P are provided on a paper insertion side of the photoreceptor 3. Meanwhile, a carrying guide plate 11 for guiding the transfer paper P on which a toner image has been transferred, a fixing device 12 for fixing the toner image which has been transferred onto the transfer paper P to the transfer paper P and a tray 13 on which the transfer paper P, to which the toner image has been fixed, is placed are provided on a discharge side of the photoreceptor 3.

The fixing device 12 is provided with a pressing roller 14, a heat roller 15 including a halogen heater 16. The pressing roller 14 and the heat roller 15 catch the transfer paper P between them as well as heat it, and they melt toner so as to fix the melted toner to the transfer paper P.

In addition, in the image forming apparatus with the above arrangement, while the document platen 1 moves in a direction of arrow X by a document platen driving unit 17 when the document is scanned, the photoreceptor 3 rotates in a direction of arrow Y by a driving means, not shown. In other words, when the document platen 1 is moved at a speed same as a peripheral speed of the photoreceptor 3 in an opposite direction to the rotating direction of the photoreceptor 3, the document placed on the document platen 1 is scanned. Here, the document driving unit 17 and the driving means, not shown, of the photoreceptor 3 are driven and controlled by a CPU 18 as controlling means.

The second exposing unit 4 and a driving motor 19 of the feeding roller 9 are connected to the CPU 18, and the CPU 18 drives and controls their members.

Figures 2A, 2B, 2C:
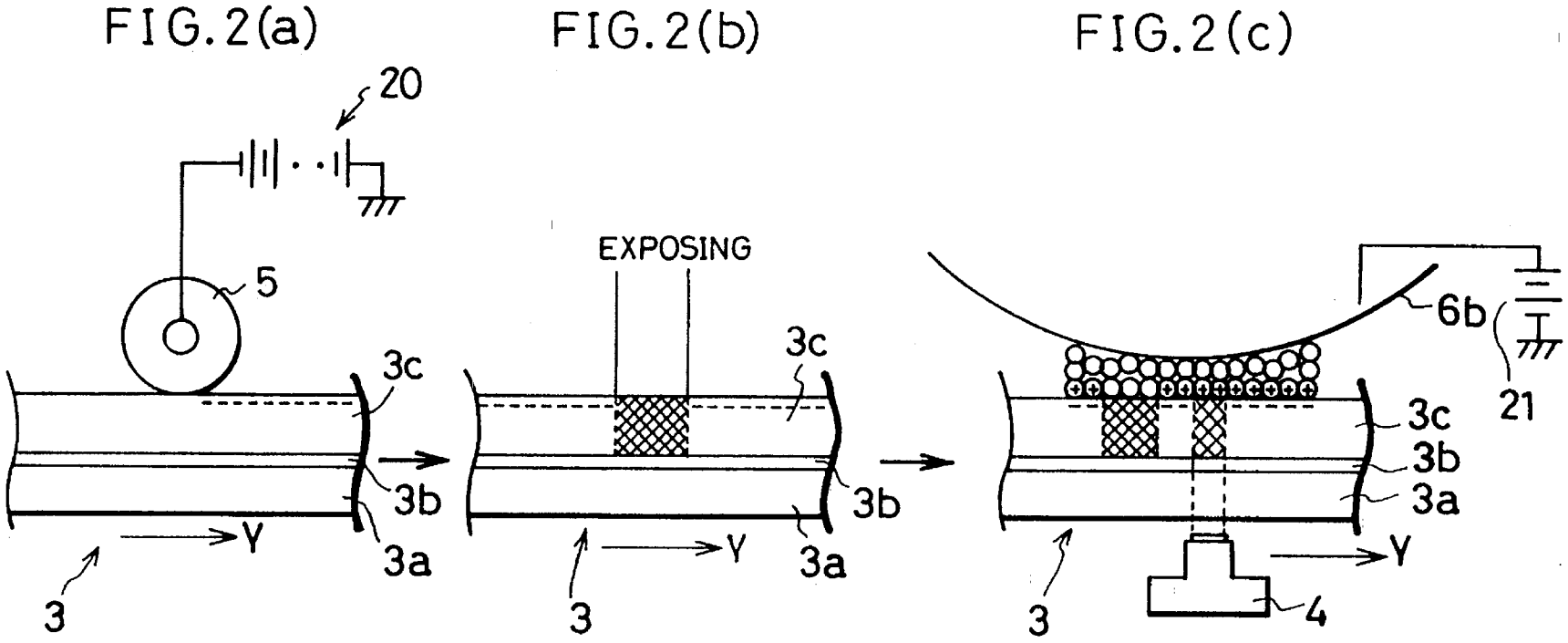
FIGS. 2(*a*) through 2(*c*) are explanatory drawings which show image forming processes by the image forming apparatus shown in FIG. 1.

Here, the following will discuss exposing operations of the first exposing unit 2 and the second exposing unit 4 referring to FIG. 2. Here, an exposed portion of the photoconductive layer **3*c*** in each exposing unit is shown by half-tone dot meshing in the drawing.

First, as shown in FIG. 2(*a*), a surface of the photoconductive layer **3*c* in the photoreceptor 3 is uniformly charged so as to have a negative polarity by the charging roller 5 which is connected to a negative pole of a charging roller power supply 20. Next, as shown in FIG. 2**(*b*), the first exposing unit 2 irradiates a light onto a photoreceptor 3 according to a document image so as to expose the surface of the photoconductive layer **3*c***.

As a result, optical carriers are generated in the exposed portion of the photoconductive layer **3*c*. The optical carriers with a positive polarity in the generated optical carriers are moved to the surface of the photoconductive layer 3*c* by electrostatic force, and charges with negative polarity are cancelled. In this way, charges are eliminated from the exposed portion (light portion) by cancelling the electric charges on the surface of the photoconductive layer 3*c***, so an electrostatic latent image in which a voltage in the light portion becomes substantially 0 V is formed.

Meanwhile, as shown in FIG. 2(*c*), the second exposing unit 4 is arranged in a position where a light is irradiated to a contact portion of the toner T which adhered to the developing roller **6*b* through magnetic force with the photoconductive layer 3*c* exposed by the first exposing unit 2. The second exposing unit 4 exposes the photoreceptor 3 from its inside according to an image signal from an external apparatus such as a computer, not shown. At this time, since the developing roller 6*b* is connected to a positive pole of a developing roller power supply 21, a voltage with a positive polarity is applied to the toner T by the developing roller 6*b*. In other words, the second exposing unit 4 performs a second exposing operation interlocking with a developing operation for the electrostatic latent image formed by the first exposing unit 2**.

Here, the light portion and the dark portion of the electrostatic latent image formed by the first exposing unit 2 are referred to as a first light portion and a first dark portion respectively, and the light portion and the dark portion of the electrostatic latent image formed by the second exposing unit 4 are referred to as a second light portion and a second dark portion respectively.

As mentioned above, in the first light portion, a surface electric potential of the photoreceptor 3 is substantially 0 V. Therefore, although the first light portion is slightly charged by injection of electric charges from the toner T, it has a substantially same potential as that of the toner T. As a result, the toner T does not adhere to the first light portion and the first light portion is not developed. Meanwhile, in the first dark portion, an electric potential with a negative polarity is maintained. Therefore, the toner T, which has been charged so as to have a positive polarity, is attracted to the first dark portion, and the first dark portion is developed. In this way, the electrostatic latent image, which has been formed by the first exposing unit 2, is developed by the normal developing system so as to be a first toner image.

In addition, in the second light portion, optical carriers are generated inside the photoconductive layer 3*c*. The optical carriers with a negative polarity in the generated optical carriers are attracted to the toner T with a positive polarity which contacts with the surface of the photoconductive layer 3*c* by electrostatic force. Therefore, the toner T is attracted to the second light portion and the second light portion is developed. Meanwhile, since optical carriers are not generated in the second dark portion, charges do not move therefrom. As a result, a state in which the toner T is attracted to the first toner image does not change. For this reason, for example, the first dark portion in the second dark portion keeps a state that the toner T is attracted thereto. Meanwhile, since the first light portion in the second dark portion holds a state that the potential on the surface of the photoconductive layer 3*c* and the potential of the toner T are equal, the toner T is not attracted to the first light portion in the second dark portion. In this way, the electrostatic latent image formed by the second exposing unit 4 is basically developed the reversal developing system so as to be a second toner image, and the second toner image and the first toner image are synthesized.

In these circumstances, the image signal from the external apparatus can be easily written onto a copy image at a high speed.

Figure 3:
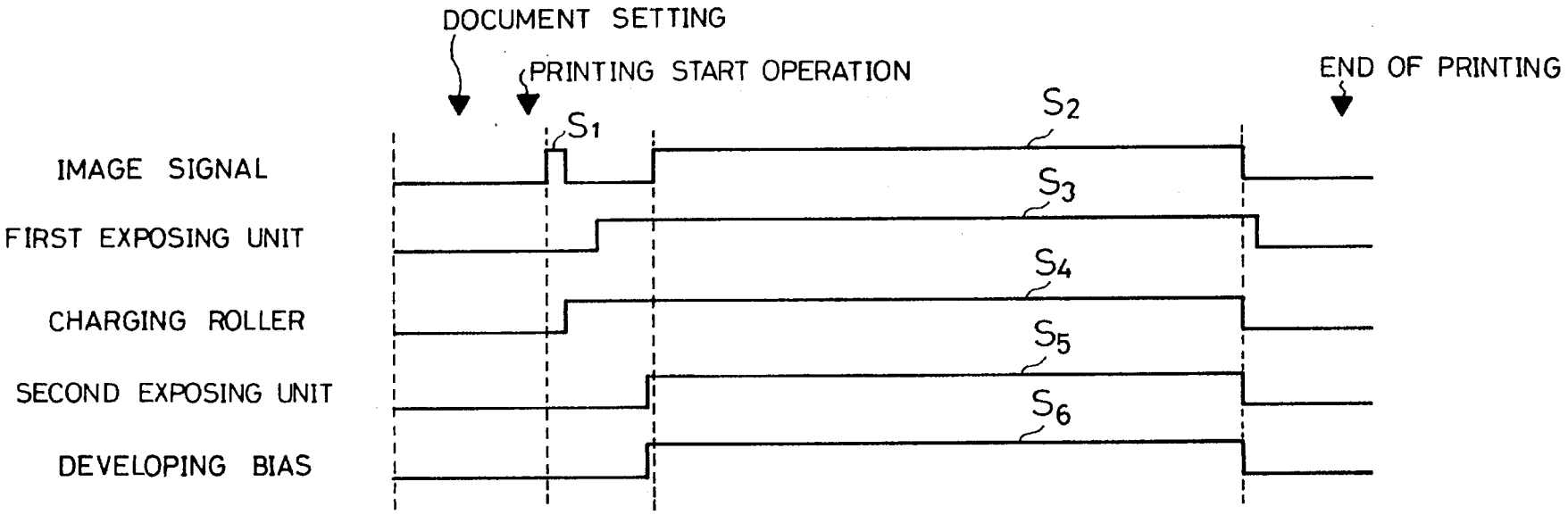
FIG. 3 is a timing chart which shows a relationship between an ON/OFF operation of an image signal and an ON/OFF operation of various control signals in the image forming process.

The following will discuss an image forming operation by the image forming apparatus with the above arrangement referring to FIGS. 1 through 3. Here, the case where further writing of a desired image onto a copy image of a document with a prescribed format, so-called overlay is performed will be explained.

First, a document with a prescribed format, for example, a ruled document is placed on the document platen 1 with a printed face of the document down. Next, printing data as an image signal are transmitted from an external host computer, not shown, to the CPU 18. When the CPU 18 detects a printing start signal from the received printing data, the CPU rotates the photoreceptor 3 in a direction of arrow Y and operates the document platen driving unit 17. The document platen driving unit 17 moves the document platen 1 until an end of the document on the document platen 1 comes to a position which corresponds to the focusing rod lens array 2*a* in the first exposing unit 2. Successively, a voltage is applied to the charging roller 5 so that the surface of the photoreceptor 3 has a prescribed potential. Here, in the present embodiment, a voltage is applied to the photoreceptor 3 so that its surface has a charge with a negative polarity.

Next, the CPU 18 moves the document platen 1 in a direction of arrow X at a same speed as a peripheral speed of the photoreceptor 3 by means of the document platen driving unit 17, and irradiates a light to the printed face of the document from the light source, not shown. A reflected light from the printed face of the document by the irradiation is focused on the surface of the photoreceptor 3 by the first exposing unit 2. As a result, the surface of the photoreceptor 3 is linearly exposed in its lengthwise direction so that an electrostatic latent image is formed.

In this way, when the electrostatic latent images which are successively formed on the photoreceptor 3 reach a position where they contact with the toner T held by the developing roller 6*b*, a bias voltage with a positive polarity is applied from the developing roller power supply 21 to the developing roller 6*b*. Successively, exposure is performed from a back of the photoconductive layer 3*c* according to the image signal by the second exposing unit 4.

Here, the toner T is composed of color particles having conductivity and magnetism as mentioned above, namely, each particle including magnetic particles made up of ferrite and carbon black in styrene-acrylic resin. Therefore, when the toner T is placed in an electric field with high intensity, the toner T shows a conductive characteristic. As a result, the optical carriers with a negative polarity generated in the photoconductive layer 3*c* are attracted by the toner T in the portion which is exposed by the second exposing unit 4, namely, the second light portion, and the toner T is also attracted by the optical carriers. As a result, a second toner image according to the image signal is formed on the photoreceptor 3. Meanwhile, since the first dark portion which is formed by the first exposing unit 2 holds a high surface potential whose polarity is opposite to that of the developing roller 6*b*, the toner T is attracted to the first dark portion so that a first toner image is formed.

In this way, the second toner image corresponding to characters of the printing data are superimposed on the first toner image corresponding to a black portion of the document.

Next, the transfer paper P is fed from the transfer paper storing cassette 10 to the transfer roller 7 by the feeding roller 9 according to the printing start signal so as to meet with the developed first and second toner images on the surface of the photoreceptor 3. The transfer roller 7 is composed of conductive and elastic member. A voltage with polarity which is opposite to that of the developing bias is applied to the transfer roller 7. Here, the first and second toner images on the photoreceptor 3 are transferred onto the transfer paper P by the bias voltage and a mechanical pressure of the transfer roller 7. The transfer paper P on which the first and the second toner images have been transferred is fed onto the carrying guide plate 11, and is put between the pressing roller 14 composed of silicone rubber and the heat roller 15 so as to be heated. As a result, the toner is fused on the transfer paper P so that the first and second toner images become fixed images. Thereafter, the transfer paper P is discharged onto the tray 13. Meanwhile, toner, which is not transferred and remains on the photoreceptor 3, is scraped off by the blade 8*a* and is collected by the cleaning unit 8.

Next, the following will discuss positioning of a copy image and a printed image in the image forming apparatus with the above arrangement referring to FIGS. 1 through 3.

First, a ruled document, for example, is placed on the document platen 1 with its printed face down. Since an end positioning plate (not shown) for the document extended in a vertical direction to a moving direction of the document platen 1 is arranged on the document platen 1, the document is placed so that the end of the document is fit to the end positioning plate. Since a scale which shows a width of a document is provided to the end positioning plate, positioning can be accurately performed with respect to a widthwise direction of the document.

Next, when a printing start operation is performed, printing data as an image signal are transmitted from the external host computer, not shown, to the CPU 18. As shown in FIG. 3, the CPU 18 detects a printing start signal $S_1$ from the received printing data, rotates the photoreceptor 3 and moves the document platen 1 so that the end of the document corresponds to the focusing rod lens array 2*a*. Then, a control signal. $S_4$ for the charging roller 5 is raised from a low level to a high level after a timer of the CPU 18 tells that a prescribed time has passed since the photoreceptor 3 started to rotate, or as shown in FIG. 3, in synchronization with falling of the printing start signal $S_1$. As a result, a voltage is applied to the charging roller 5 so that the surface potential of the photoreceptor 3 becomes a prescribed potential.

Successively, a point in time when a charging range of the photoreceptor 3 reaches the focusing rod lens array 2*a*, namely, a position where exposure is performed by the first exposing unit 2 is measured by the timer of the CPU 18. When a counted value by the timer reaches a set value, a control signal $S_3$ for the first exposing unit 2 is raised from a low level to a high level and a light is irradiated to the document. A reflected light from the document is focused by the focusing rod lens array 2*a* and is irradiated on the photoreceptor 3. At this time, the document platen driving unit 17 is activated so as to move the document platen 1 in a direction of arrow X (see FIG. 1) at a prescribed speed. As a result, an electrostatic latent image corresponding to the document is formed on the photoreceptor 3.

A point in time when the electrostatic latent image reaches a developing range by the developer unit 6 is detected according to a value counted by the timer of the CPU 18. Therefore, while a detection is made that the electrostatic latent image reaches the developing range, a control signal $S_5$ for the second exposing unit 4 and a control signal $S_6$ of a developing bias for the developer unit 6 are raised from a low level to a high level. Moreover, immediately after that, namely, when all the control signals $S_3$ through $S_6$ are in a high level, the CPU 18 transmits an image signal $S_2$ with a high level to the second exposing unit 4. As a result, a bias voltage with a polarity opposite to that of the charging roller 5, namely with a positive polarity is applied to the developing roller 6*b*, and while an electrostatic latent image corresponding to the document is being developed, the second exposing unit 4 exposes the photoreceptor 3 from the back of the photoconductive layer 3*c* according to the image signal $S_2$.

In this way, the electrostatic latent image corresponding to the document is developed at the same time that the electrostatic latent image according to the image signal is formed and developed. In other words, the image data from an external apparatus can be easily overlaid on the copy image corresponding to the document at a high speed only by placing the document on the document platen 1 and by performing the printing start operation.

Here, when the image signal $S_2$ falls from a high level to a low level, the above-mentioned control signals $S_3$ through $S_6$ are in a low level substantially at the same time.

In the image forming apparatus with the above arrangement, in a series of image forming processes for forming a copy image and a printer image, a toner image can be formed in an unexposed portion by copying a document, and a toner image can be formed in an exposed portion by printing using a printer. As a result, a light emitting time of the second exposing unit 4 is shorter in the printing using a printer compared to the conventional case where printing is carried out on an unexposed portion, thereby making it possible to decrease consumption of members such as the second exposing unit 4, the photoreceptor 3. As a result, a service life or a replacing period of each parts in the image forming apparatus can be prolonged.

In addition, since the toner image is formed on the exposed portion in the printing using a printer, in the case particularly where the toner image corresponds to characters, an exposed range can be reduced. This makes it possible to eliminate a possibility that a printer image is blotted with a copy image previously formed in a border between the copy image and the printer image, so an quality of an overlay image can be improved.

Furthermore, a copying operation of a document is started by a printing start signal included in the image signal, thereby making it possible to easily overlay the printer image on the copy image at a high speed.

In addition, when the focusing rod lens array 2*a* is used as the first exposing unit 2, a space between the document platen 1 and the photoreceptor 3 can be smaller compared to the case where a plurality of reflecting mirrors, etc. are used, thereby making it possible to miniaturize an apparatus. Moreover, since the second exposing unit 4 is provided in the photoreceptor 3, an apparatus can be further miniaturized.

In addition, toner with a same polarity can be used for image formed by the first exposing unit 2 and the second exposing unit 4, thereby making it possible to easily carry out overlay at a high speed.

Further, when an image signal is generated from a graphic image and processed by a printer, much processing time and a memory with a great capacity is required. However, in the image forming apparatus with the above arrangement, time to form an image can be greatly reduced by performing an copying operation on the graphic image and then by performing a printer operation only on printing data.

Here, in the present embodiment, as a developer, color particles having conductivity and magnetism, namely, particles including magnetic particles made up of ferrite, and carbon black in styrene-acrylic resin are used, but the developer is not limited to this. In other words, at least a charge may be applied from the developing roller 6*b* to a developer which contacts with the surface of the photoconductive layer 3*c* in the photoreceptor 3. Therefore, a monocomponent developer in which magnetic particles is dispersed in resin or a tow-components developer composed of electrically conductive and magnetic carrier and insulating toner may be used.

[EMBODIMENT 2]

The following will discuss another embodiment of the present invention. Here, for convenience of explanation, those members that have the same arrangement and functions, and that are described in the aforementioned embodiments are indicated by the same reference numerals and the description thereof is omitted.

Figure 4:
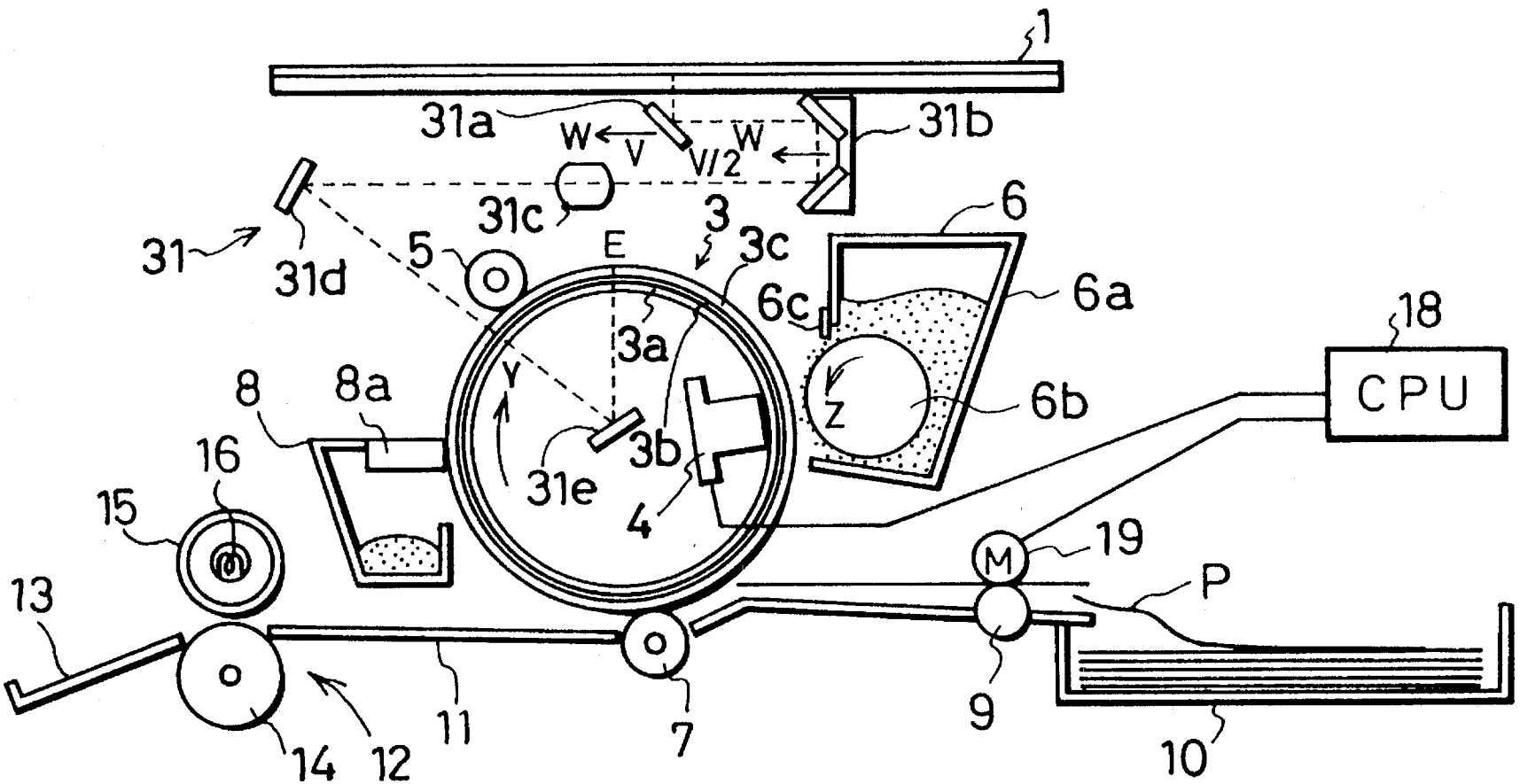
FIG. 4 is an explanatory drawing which schematically shows another constitutional example of the image forming apparatus of the present invention.

As shown in FIG. 4, an image forming apparatus of the present invention includes a first exposing unit 31 instead of the first exposing unit 2 provided in the image forming apparatus of the embodiment 1 shown in FIG. 1.

The first exposing unit 31 has a first mirror 31*a*, a second mirror unit 3l*b*, a lens section 31*c* composed of an even number of lenses, a third mirror 31*d* and a fourth mirror 31*e*. When a light is irradiated from a light source, not shown, on a document placed on a document platen 1, a reflected light from the document is reflected from or transmitted through the above-mentioned optical members 31*a* through 31*e* in this order. Thereafter the reflected light exposes the photoreceptor 3.

The first mirror 31*a* moves in a direction of arrow W when the document is scanned. Its travel speed is same as a rotating speed V of a photoreceptor 3 in a direction of arrow Y. Since the second mirror unit 31*b* is composed of two mirrors and it moves in the direction of arrow W towards a reflected face of the first mirror 31*a*, a travel speed of the second mirror unit 31*b* is set to ½ of the travel speed of the first mirror 31*a*. This makes it possible to keep a length of an optical path from the printed face of the document to the lens section 31*c* constant even when the first mirror 31*a* and the second mirror unit 31*b* move at the time of scanning the document.

In addition, the fourth mirror 31*e* is positioned in the photoreceptor 3, and it irradiates a light from the back of the photoreceptor 3. Hereinafter, a position from which a light is irradiated to the photoreceptor 3 by the fourth mirror 31*e* is referred to as an exposing position E.

Here, transmission efficiency of a light in the case where a focusing rod lens array 2*a* is used is substantially same as transmission efficiency of a light in the case where a plurality of mirrors are used and the photoreceptor 3 transmits a light. One of its reasons is because a light which is not absorbed by a light transmitting electrically conductive layer 3*b* and a photoconductive layer 3*c* is transmitted without being reflected on a light transmitting base material 3*c*. Therefore, in the both cases, a charging potential of the photoreceptor 3 can be set to a same optimum value.

However, the third mirror 31*d* and the fourth mirror 31*e* are positioned so that the optical path from the third mirror 31*d* to the fourth mirror 31*e* crosses the photoreceptor 3 on an upper stream side than a position where the photoreceptor 3 is charged by a charging roller 5. This is because when the optical path crosses the photoreceptor 3 between a contact section of the photoreceptor 3 and of the charging roller 5*a* and a contact section of the photoreceptor 3 and of a developing roller 6*b*, an electrostatic latent image formed on the exposing position E is affected.

Therefore, when the optical path crosses the photoreceptor 3 on an downstream side than the contact section of the photoreceptor 3 and the developing roller 6*b*, a state of photoreceptor is not affected. However, in order to reduce a possibility that an amount of received light of the fourth mirror 31*e* is decayed by an toner image, it is preferable that the optical path crosses the photoreceptor 3 on the downstream side than a transfer position of the photoreceptor 3, namely, the contact section of the photoreceptor 3 and a transfer roller 7. It is more preferable that the optical path crosses the photoreceptor 3 on the lower side than a cleaning unit 8.

Figure 5:
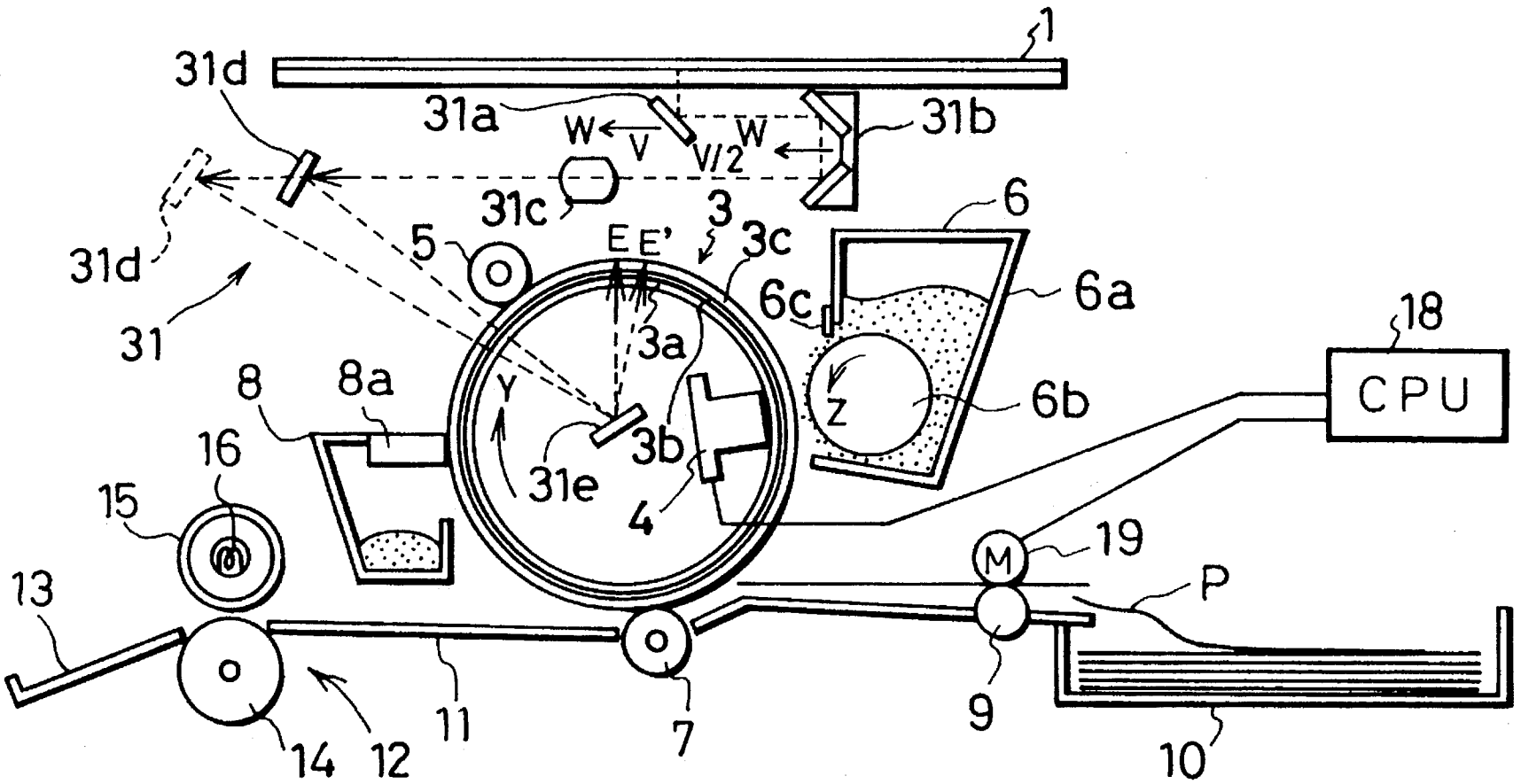
FIG. 5 is an explanatory drawing which shows an operation of changing a copying magnification in the image forming apparatus shown in FIG. 4.

In addition, since the lens section 31*c* is composed of a plurality of lenses, a focal length of the lens section 31*c* can be changed by changing a clearance between the housed lenses or by changing a position of the lens section 31*c*. In other words, a magnification of an optical image formed on the surface of the photoreceptor 3 can be changed. As the focal length of the lens section 31*c* changes, as shown in FIG. 5, for example, the third mirror 31*d* is allowed to move to a position shown by dotted lines. At this time, the magnification of the optical image can be changed without moving the fourth mirror 31*e* by changing a slope of the third mirror 31*d* so as to move the exposing position E to an exposing position E'. As mentioned above, even in the case where the surface of the photoreceptor 3 is exposed from its inside, the magnification of the optical image can be freely changed.

Figures 6A, 6B, 6C:
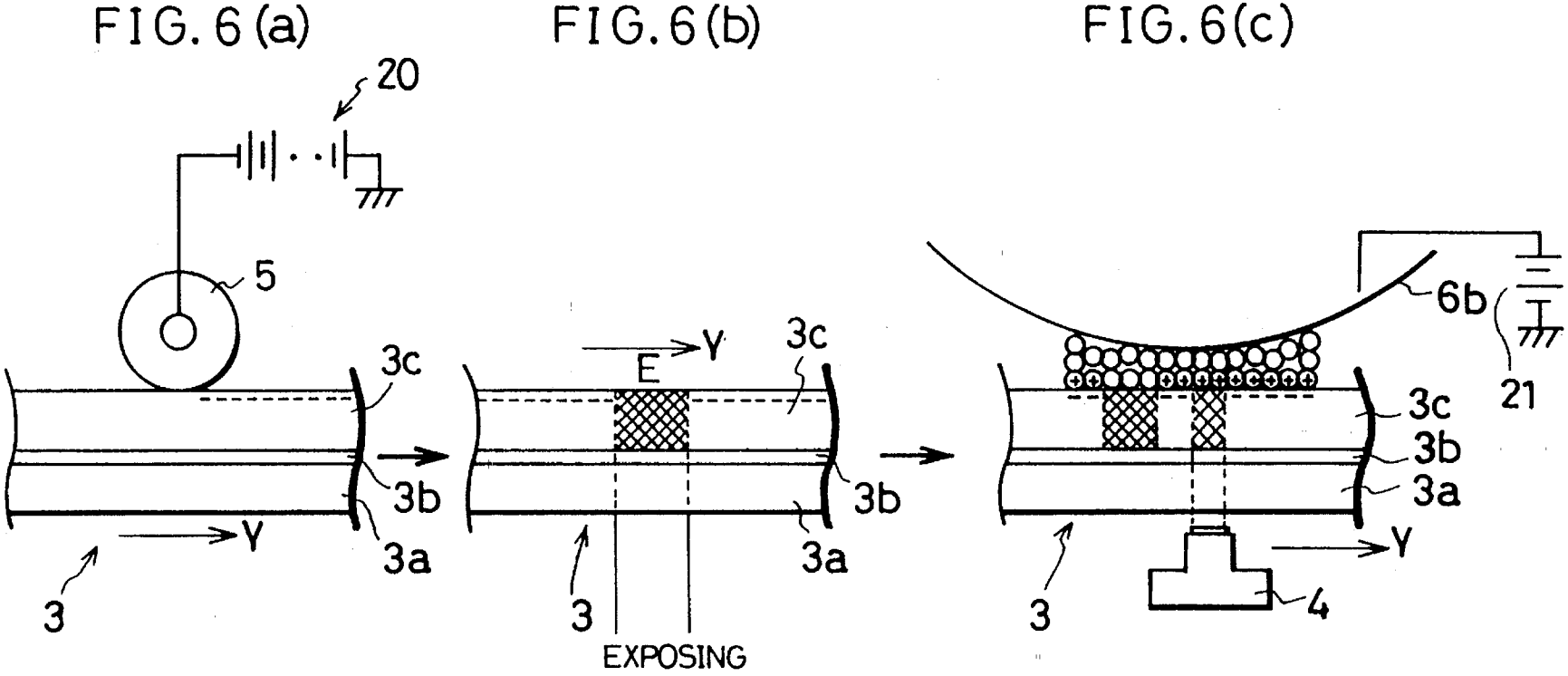
FIGS. 6(*a*) through 6(*c*) are explanatory drawings which show image forming processes by the image forming apparatus shown in FIG. 4.

Here, the following will discuss exposing operations of the first exposing unit 31 and a second exposing unit 4 referring to FIG. 6. Here, an exposed portion in the photoconductive layer 3*c* in each exposing unit is shown by half-tone dot meshing in the drawing.

First, as shown in FIG. 6(*a*), the surface of the photoconductive layer 3*c* in the photoreceptor 3 is uniformly and negatively charged by the charging roller 5 which is connected to a negative pole of charging roller power supply 20. Next, as shown in FIG. 6(*b*), the first exposing unit 31 irradiates a light according to a document image on the back surface of the photoreceptor 3, namely the light transmitting base material 3*a*. As a result, the photoconductive layer 3*c* is exposed in the exposing position E by the light according to the document image.

This generates optical carriers inside the exposed portion of the photoconductive layer 3*c*, and the positive optical carriers in the generated optical carriers move to the surface of the photoconductive layer 3*c* by means of electrostatic force so as to cancel a charge with negative polarity. In this way, a charge is eliminated from the exposed portion (light portion) by cancelling charges on the surface of the photoconductive layer 3*c*, so an electrostatic latent image where a voltage in the light portion is substantially 0 V is formed.

Meanwhile, as shown in FIG. 6(*c*), the second exposing unit 4 is positioned in a position from which a light is irradiated to a contact portion of toner T which is attracted to the developing roller 6*b* through magnetic force and of the photoconductive layer 3*c* , exposed by the first exposing unit 31. Then, the second exposing unit 4 exposes the photoreceptor 3 from its inside according to an image signal from an information processing apparatus such as a computer, not shown. At this time, since the developing roller 6*b* is connected to a positive side of a developing roller power source 21, a voltage with positive polarity is applied to the toner T by the developing roller 6*b*. In other words, the second exposing unit 4 performs the exposing operation being interlocked with a developing operation on the electrostatic latent image formed by the first exposing unit 31.

Forming of the electrostatic latent image by the first exposing unit 31 and the second exposing unit 4 is same as that by the first exposing unit 2 and the second exposing unit 4 explained in the embodiment 1.

The following will discuss an image forming operation by the image forming apparatus with the above arrangement referring to FIG. 4.

First, a document with a prescribed format, for example, a ruled document is placed on the document platen 1 with its printed face down. Next, printing data are transmitted from an external host computer, not shown, to a CPU 18. When the CPU 18 detects a printing start signal from the received printing data, the CPU 18 rotates the photoreceptor 3 in a direction of arrow Y at a speed V. The CPU 18 also applies a voltage to the charging roller 5 so that the surface of the photoreceptor 3 has a prescribed potential. Here, in the present embodiment, a voltage is applied to the photoreceptor 3 So that its surface is negatively charged.

Successively, the CPU 18 drives and controls mirror driving means, not shown, and moves the first mirror 31*a* in a direction of arrow W at a speed which is same as the rotating speed V of the photoreceptor 3 in the direction of arrow Y. Then, the CPU 18 moves the second mirror unit 31*b* in a direction of arrow W at a speed of V/2 so as to start scanning the document. At this time, a light is irradiated from a light source, not shown, on the document placed on the document platen 1. After a reflected light from the document by the irradiation passes through the first mirror 31*a*, the second mirror unit 31*b*, the lens section 31*c*, the third mirror 31*d* and the fourth mirror 31*e*, the reflected light is focused in the exposing position E on the surface of the photoreceptor 3. As a result, the surface of the photoreceptor 3 is linearly exposed according to ruled lines of the document so that an electrostatic latent image is formed.

When the electrostatic latent images successively formed on the photoreceptor 3 in such a manner reaches a position where they contact with the toner T held by the developing roller 6*b*, a bias voltage with a positive polarity is applied to the developing roller 6*b* from the developing roller power supply 21, and successively exposure is performed according to an image signal by the second exposing unit 4. In this way, the electrostatic latent image formed by the second exposing unit 4 and the electrostatic latent image which has been previously formed by the first exposing unit 31 are synthesized.

Thereafter, each process of development, fixing and cleaning was explained in the embodiment 1. Moreover, as mentioned in the embodiment 1, control based upon a timing chart shown in FIG. 3 can be applied to the present embodiment.

As mentioned above, when the first exposing unit 31 exposes the surface of the photoconductive layer 3*c* from the light transmitting electrically conductive layer 3*a* side of the photoreceptor, compared to the case where the first exposing unit 31 is provided on the photoconductive layer 3*c* side of the photoreceptor 3, a clearance between a copying document and the photoreceptor 3 can be further shortened. This makes it possible to thin the apparatus.

Figure 7:
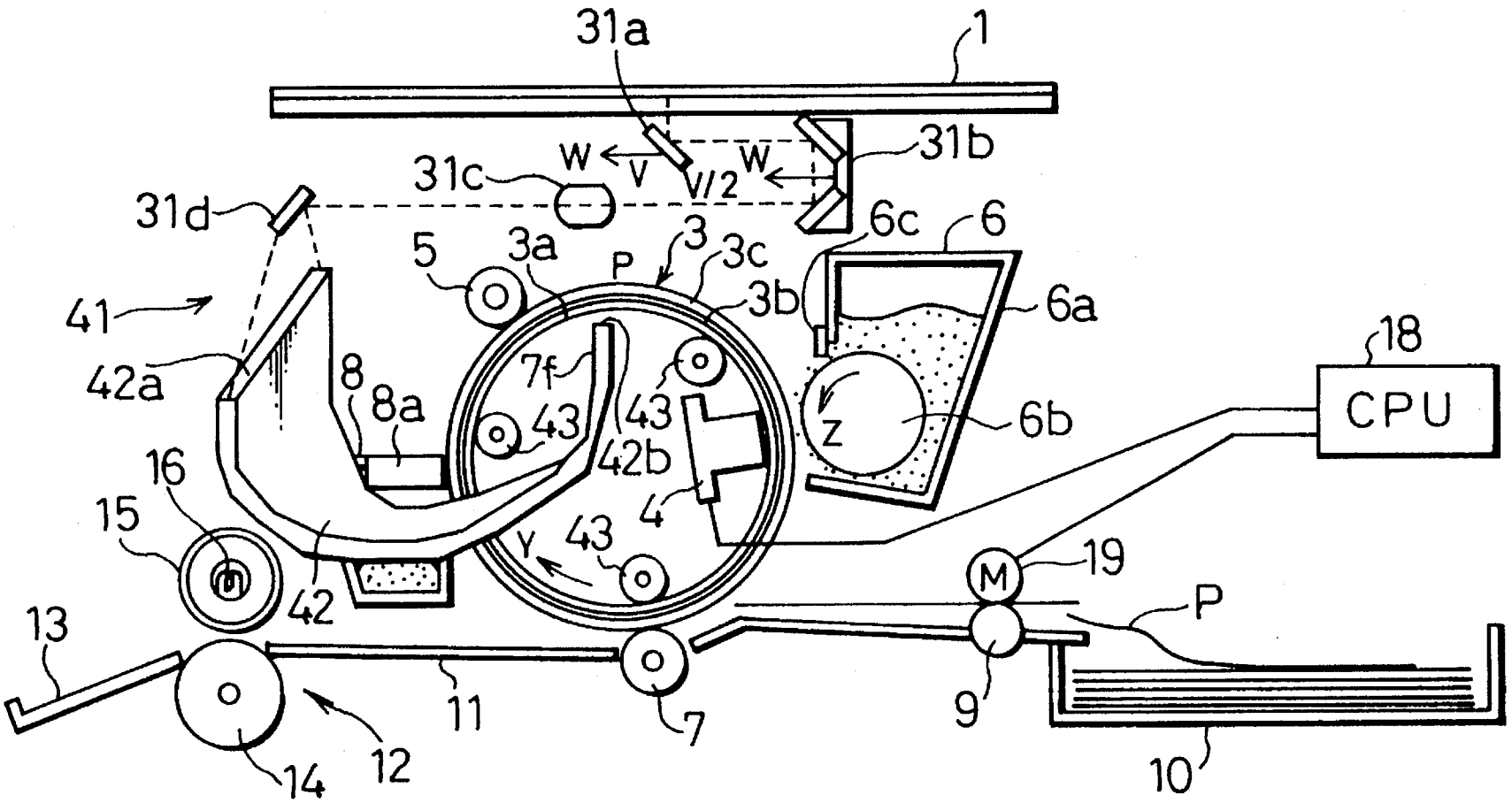
FIG. 7 is an explanatory drawing which schematically shows still another constitutional example of the image forming apparatus of the present invention.

In addition, in the first exposing unit 31, a plurality of mirrors are used as means for transmitting a reflected light from the document to the photoreceptor 3, but like a first exposing unit 41 shown in FIG. 7, for example, an optical fiber 42 in which optical fibers as light transmitting means are bundled on a portion of the optical path from a document to the photoreceptor 3 may be used.

The optical fiber 42 is arranged so that a reflected light of the third mirror 31*d* can be irradiated to a light incident opening 42*a* and that the light outgoing opening 42*b* can irradiate a light to an exposing position P on the surface of the photoconductive layer 3*c* from the inside of the photoreceptor 3.

In this case, the photoreceptor 3 is held by a plurality of guide rollers 43 . . . so that the rollers 43 . . . contact with the inner side of the light transmitting electrically conductive layer 3, and it is rotated in a direction of arrow Y by driving means, not shown, provided outside the photoreceptor 3. For this reason, an end of the photoreceptor 3 which is vertical to its longitudinal direction can get open. Therefore, the optical fiber 42 can be freely provided in the photoreceptor 3 from its end side.

In such a way, when the optical fiber 42 is used on the portion of the optical path for the reflected light from the document, namely, the optical path from the third mirror 31*d* to the exposing position P of the photoreceptor 3, it is not necessary to limit the position where the optical path for the reflected light from the third mirror 31*d* crosses the photoreceptor 3 to the upper stream side of the charging roller 5, so a degree of freedom of a design is increased.

In addition, since the light outgoing opening 42*b* faces the light transmitting electrically conductive layer 3*a* in the photoreceptor 3, even if the light outgoing opening 42*b* is close to a developing position, it is not soiled by toner. Therefore, a light can be irradiated from the light outgoing opening 42*b* to the exposing position P without arising a problem that an amount of a light is decayed by soil. This makes it possible to always obtain an excellent image.

In addition, when the optical fiber 42 which is capable of freely changing its shape as mentioned above is used as light transmitting means for transmitting a reflected light from a document in the first exposing unit 41, an apparatus can be produced without restriction of a shape of an apparatus.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

a photoreceptor which is capable of moving in a prescribed direction, said photoreceptor being provided with a light-transmitting base material, a light-transmitting electrically conductive layer and a photoconductive layer, in this order;

charging means charging a surface of the photoconductive layer so as to have a prescribed polarity;

first exposing means directing light onto a first position of the photoconductive layer on a downstream side of said charging means, defined with respect to said prescribed direction of movement of said photoreceptor, so as to form a first electrostatic latent image in which a light-exposed portion thereof has a surface voltage which is substantially zero;

developing means developing said first electrostatic latent image by bringing a developer, which is charged so as to have a polarity opposite to the polarity of the surface of the photoconductive layer, into contact with the photoconductive layer, said developing means being provided on a downstream side of said first exposing means; and second exposing means irradiating a contact portion of the developer and of the photoconductive layer by interlocking with the developing operation of said developing means so as to form a second electrostatic latent image with the second electrostatic latent image superimposed on the developed first electrostatic latent image.

2. The image forming apparatus as defined in claim 1, wherein:

said first exposing means includes an optical system which focuses light reflected from a document, to which light has been applied, onto the photoconductive layer and said second exposing means emits light according to an image signal applied thereto.

3. The image forming apparatus as defined in claim 1, wherein said first exposing means includes a focusing rod lens array which focuses light reflected from a document, to which light has been applied, onto the photoconductive layer.

4. An image forming apparatus comprising:

a photoreceptor which is capable of moving in a prescribed direction, said photoreceptor being provided with a light-transmitting base material, a light-transmitting electrically conductive layer and a photoconductive layer, in this order;

charging means charging a surface of the photoconductive layer so as to have a prescribed polarity;

first exposing means directing light onto a first position of the photoconductive layer on a downstream side of said charging means, defined with respect to said prescribed direction of movement of said photoreceptor, so as to form a first electrostatic latent image in which a light-exposed portion thereof has a surface voltage which is substantially zero;

developing means developing said first electrostatic latent image by bringing a developer, which is charged so as to have a polarity opposite to the polarity of the surface of the photoconductive layer, into contact with the photoconductive layer, said developing means being provided on a downstream side of said first exposing means: and second exposing means irradiating a contact portion of the developer and of the photoconductive layer by interlocking with the developing operation of said developing means so as to form a second electrostatic latent image, with the second electrostatic latent image superimposed on the developed first electrostatic latent image, said first exposing means including an optical system which directs light reflecting from a document, to which light has been applied, onto a light-transmitting base material side of said photoreceptor, and said first electrostatic latent image is formed by irradiating the photoconductive layer from the light-transmitting base material side.

5. An image forming apparatus comprising:

a photoreceptor which is capable of moving in a prescribed direction, said photoreceptor being provided with a light-transmitting base material, a light-transmitting electrically conductive layer and a photoconductive layer, in this order;

charging means charging a surface of the photoconductive layer so as to have a prescribed polarity;

first exposing means directing light onto a first position of the photoconductive layer on a downstream side of said charging means, defined with respect to said prescribed direction of movement of said photoreceptor, so as to form a first electrostatic latent image in which a light-exposed portion thereof has a surface voltage which is substantially zero;

developing means developing said first electrostatic latent image by bringing a developer, which is charged so as to have a polarity opposite to the polarity of the surface of the photoconductive layer, into contact with the photoconductive layer, said developing means being provided on a downstream side of said first exposing means; and second exposing means irradiating a contact portion of the developer and of the photoconductive layer by interlocking with the developing operation of said developing means so as to form a second electrostatic latent image, with the second electrostatic latent image superimposed on the developed first electrostatic latent image, wherein said photoconductive layer has a light-transmitting characteristic, and said first exposing means includes:

an optical system directing light so that the light passes through the photoreceptor at a second position, upstream of said first position and is led into the photoreceptor; and an optical element directing the light led into the photoreceptor to the first position so that the first electrostatic latent image is formed by irradiating the first position of the photoconductive layer from the light-transmitting base material side.

6. The image forming apparatus as defined in claim 1, wherein:

said first exposing means includes an optical system which focuses light reflected from a first document, to which light has been applied, onto the photoconductive layer and said second exposing means emits light corresponding to a black portion of a second document, according to an image signal applied to said second exposing means.

7. The image forming apparatus as defined in claim 1, wherein:

said developer has conductivity and magnetism, said developing means includes a non-magnetic cylindrical member which contains an aggregate of magnets and which is capable of rotating, said cylindrical member has conductivity at least on its surface, said developer is held on the surface of the cylindrical member and is carried by a relative movement of the cylindrical member and the aggregate of magnets.

8. The image forming apparatus as defined in claim 1, wherein said developer includes a plurality of particles, each of which is made by mixing conductive particles, magnetic particles and color particles with a base material.

9. The image forming apparatus as defined in claim 1, wherein said developer includes carrier particles with conductivity and magnetism and color particles with a insulating characteristic.

10. The image forming apparatus as defined in claim 2, further comprising control means for activating said charging means and said first exposing means when the image signal is detected.

11. The image forming apparatus as defined in claim 3, further comprising:

a document platen on which the document is placed; and driving means for moving said document platen at a same speed as a speed of said photoreceptor and the document is scanned by a light.

12. The image forming apparatus as defined in claim 4, wherein said optical system includes an optical fiber.

13. The image forming apparatus as defined in claim 5, wherein said second position is upstream with respect to a charging position of said charging means and is downstream with respect to a developing position of said developing means.

14. The image forming apparatus as defined in claim 5, further comprising:

cleaning means for removing residual developer on said photoreceptor after a toner image formed on said photoreceptor is transferred onto paper by said developing means, wherein said second position is upstream with respect to a charging position of said charging means and is downstream with respect to a cleaning position of said cleaning means.

15. An image forming apparatus comprising:

a photoreceptor which is capable of moving in a prescribed direction, said photoreceptor being provided with a light-transmitting base material, a light-transmitting electrically conductive layer and a photoconductive layer, in this order;

charging means charging a surface of the photoconductive layer so as to have a prescribed polarity;

first exposing means directing light onto a first position of the photoconductive layer on a downstream side of said charging means, defined with respect to said prescribed direction of movement of said photoreceptor, so as to form a first electrostatic latent image in which a light-exposed portion thereof has a surface voltage which is substantially zero;

developing means developing said first electrostatic latent image by bringing a developer, which is charged so as to have a polarity opposite to the polarity of the surface of the photoconductive layer, into contact with the photoconductive layer, said developing means being provided on a downstream side of said first exposing means; and second exposing means irradiating a contact portion of the developer and of the photoconductive layer by interlocking with the developing operation of said developing means so as to form a second electrostatic latent image, with the second electrostatic latent image superimposed on the developed first electrostatic latent image, wherein said photoconductive layer has a light-transmitting characteristic, and said first exposing means includes:

an optical system directing light so that the light passes through the photoreceptor at a second position, upstream of said first position and is led into the photoreceptor; and an optical element directing the light led into the photoreceptor to the first position so that the first electrostatic latent image is formed by irradiating the first position of the photoconductive layer from the light-transmitting base material side, wherein said optical system includes:

a first optical member for changing a focal length of the light applied to the photoconductive layer in the first position; and a second optical member having a reflecting surface directing the light, which has passed through said first optical member, to the second position, said second optical member moving and changing a direction of the reflecting surface according to the change of the focal length by said first optical member.

16. The image forming apparatus as defined in claim 12, wherein:

said photoreceptor has a drum shape such that at least one of ends is open, said optical fiber is provided so as to come into said photoreceptor from the open end.

17. The image forming apparatus as defined in claim 15, wherein:

said optical element inside the photoreceptor is secured, said first position moves on the photoconductive layer according to the change of the focal length by the first optical member.

18. The image forming apparatus as defined in claim 15, wherein:

said developer has conductivity and magnetism, said developing means includes a non-magnetic cylindrical member which contains an aggregate of magnets and which is capable of rotating, said cylindrical member has conductivity at least on its surface, said developer is held on the surface of the cylindrical member and is carried by a relative movement of the cylindrical member and the aggregate of magnets.

19. The image forming apparatus as defined in claim 15, wherein said developer includes a plurality of particles, each of which is made by mixing conductive particles, magnetic particles and color particles with a base material.

20. A method of forming an image, in which a first electrostatic latent image corresponding to a first document has superimposed upon it a second electrostatic latent image corresponding to a second document, comprising the steps of:

detecting an image-forming start signal from an image signal generated based upon the second document, so as to apply a charge with a prescribed polarity to a surface of a photoreceptor;

scanning the first document with light, so as to form the first electrostatic latent image by applying light reflected from the first document to the surface of the photoreceptor;

applying a charge, with a polarity opposite to the prescribed polarity, to a developer when the first electrostatic latent image reaches a developing position during movement of the surface of the photoreceptor; and forming the second electrostatic latent image by applying light, which is generated according to said image signal, to a back surface of the photoreceptor at a developing position on the photoreceptor, whereby the second electrostatic latent image is developed immediately after being formed such that said first electrostatic latent image and said second electrostatic latent image are synthesized during said developing.

* * * * *